US006550649B2

(12) United States Patent
Han et al.

(10) Patent No.: US 6,550,649 B2
(45) Date of Patent: Apr. 22, 2003

(54) COUNTER BALANCED EFFLUENCE TRANSFER SYSTEM

(75) Inventors: Leon Han, San Jose, CA (US); Ted L. McGill, Cupertino, CA (US)

(73) Assignee: ChemFlow Systems, Inc., San Jose, CA (US)

( * ) Notice: Subject to any disclaimer, the term of this patent is extended or adjusted under 35 U.S.C. 154(b) by 4 days.

(21) Appl. No.: 09/876,545

(22) Filed: Jun. 6, 2001

(65) Prior Publication Data

US 2002/0066495 A1 Jun. 6, 2002

Related U.S. Application Data

(60) Provisional application No. 60/250,667, filed on Dec. 4, 2000.

(51) Int. Cl.[7] ..... B67D 5/00

(52) U.S. Cl. ..... 222/166; 222/164; 141/266; 141/284; 141/319; 141/364; 141/414; 141/419; 141/758

(58) Field of Search ..... 222/164–167, 222/463, 604, 605; 141/250, 266, 284, 319–322, 364; 414/408, 419, 421, 758, 769–771, 781, 783

(56) References Cited

U.S. PATENT DOCUMENTS 1,509,597 A * 9/1924 Heltzel ..... 193/5
1,527,962 A * 2/1925 Lamb ..... 222/113
2,133,474 A * 10/1938 Roscoe ..... 141/284
2,339,396 A * 1/1944 Harvey ..... 134/93
3,334,884 A * 8/1967 Suzuki et al. ..... 141/271
3,350,083 A * 10/1967 Buhrer et al. ..... 222/166
3,372,714 A * 3/1968 Schmidt ..... 141/1
3,900,134 A * 8/1975 Larson ..... 137/78.2
4,558,421 A * 12/1985 Shriver ..... 164/151.1
4,568,239 A * 2/1986 Sims ..... 222/166
4,585,148 A * 4/1986 Ito ..... 141/104
4,632,009 A * 12/1986 Dann ..... 222/161
4,940,335 A * 7/1990 Gibson ..... 222/166
5,275,662 A * 1/1994 Wendler et al. ..... 118/100
5,586,692 A * 12/1996 Livengood ..... 141/391
6,053,218 A * 4/2000 Boers ..... 141/100
6,213,352 B1 * 4/2001 Boyer, Jr. ..... 141/319
6,357,988 B1 * 3/2002 Bayne ..... 220/555
6,379,034 B1 * 4/2002 Schutz ..... 222/166

* cited by examiner

*Primary Examiner*—J. Casimer Jacyna
(74) *Attorney, Agent, or Firm*—Pacific Law Group LLP; Chi Ping Chang

(57) ABSTRACT

A counter balanced effluence transfer system for the transfer of effluence from a source container into a receiving reservoir comprises a receiving reservoir having a cover plate and a reservoir top opening, and a counter balanced mechanism located above the receiving reservoir, which includes a pivot point, a source-side member attached to one side of the pivot point and a balance-side member attached to the other side of the pivot point. While the size and weight of the source-side member are made the same as those of the balance-side member, an angular asymmetry is built in between the source arm and the balance arm so that the gravitational source torque $T_s$ and the gravitational balance torque $T_b$ are made unequal. Upon release of the counter balanced mechanism with a latching starting mechanism, the counter balanced mechanism would automatically rotate and complete the pouring of source effluence into the receiving reservoir.

13 Claims, 5 Drawing Sheets

COUNTER BALANCED EFFLUENCE TRANSFER SYSTEM

RELATED APPLICATION

This application is a formal application of a provisional application filed on Dec. 4, 2000, Ser. No. 60/250,667.

FIELD OF THE INVENTION

This invention is related to an effluence transfer system. More specifically, this invention concerns a semi-automatic, totally mechanical system for the transfer, using gravity, of a variety of effluence including, but not limited to, fluids, chemicals and flowable slurries using gravity.

BACKGROUND OF THE INVENTION

The existence and operation of a wide variety of effluence transfer systems have been around for a long time. An example of a simple mechanical effluence transfer system is a hand-cranked pump to draw water from a source reservoir and transfer it to a receiving bottle. A second example of a totally sealed and sophisticated system for the transferring of hazardous chemical slurry from a mixing tank to a reactor module is an electronic-controlled peristaltic pump having automatic pressure and flow-sensors and using a totally sealed system of chemical-resistant piping. However, for the semi-automatic transferring of effluence from containers, with capacity up to a few gallons, into a receiving reservoir there has been the need of a simple mechanical system that is safe, reliable and simple to operate.

SUMMARY OF THE INVENTION

The first objective of this invention is to devise a counter balanced effluence transfer system, or CBETS, that is semi-automatic and totally mechanical.

The second objective of this invention is to provide for a CBETS that is safe, reliable and simple to operate.

Other objectives, together with the foregoing are attained in the exercise of the invention in the following description and resulting in the embodiment illustrated in the accompanying drawings.

BRIEF DESCRIPTION OF DRAWINGS

The current invention will be better understood and the nature of the objectives set forth above will become apparent when consideration is given to the following detailed description of the preferred embodiments. For clarity of explanation, the detailed description further makes reference to the attached drawings herein.

DETAILED DESCRIPTION OF PREFERRED EMBODIMENTS

In the following detailed description of the present invention, numerous specific details are set forth in order to provide a thorough understanding of the present invention. However, it will become obvious to those skilled in the art that the present invention may be practiced without these specific details. In other instances, well known methods, procedures and components have not been described in detail to avoid unnecessary obscuring aspects of the present invention.

Reference herein to "one embodiment" or an "embodiment" means that a particular feature, structure, or characteristics described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments.

Figure 1:
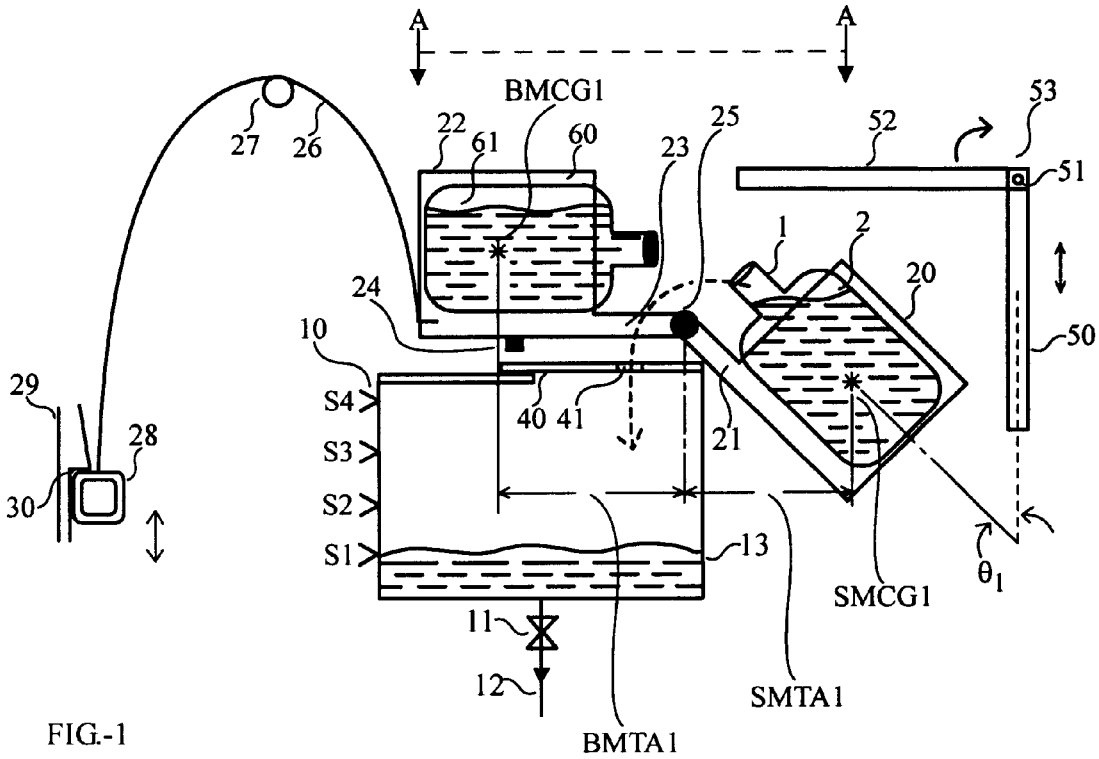
FIG.-1 illustrates a first side view of the current CBETS in its initial starting state wherein a handle component and an integral safety interlock feature are both placed in its latched position to prevent the starting of the effluence transferring process.

FIG.-1 illustrates a first side view of the current CBETS in its initial starting state wherein a handle component and an integral safety interlock feature are both placed in its latched position to prevent the starting of the effluence transferring process. Source effluence 2 enclosed inside source container 1, whose cap has previously been separately removed, is to be transferred into receiving reservoir 10 that is illustrated with an initial reservoir effluence level 13 at an elevation of S1. Additional elevations of the reservoir effluence level for future illustration are marked as S2, S3 and S4. For further usage of its effluence, receiving reservoir 10 is equipped with an output valve 11 and an output pipe 12. Source container 1 is removably held with a source container holder 20 that is linked to a pivot with bearing 25 via a source arm 21. In a somewhat opposing manner to the source container 1, balance container 60 containing sealed balance effluence 61 is lockably held with balance container holder 22 that is also linked to the pivot with bearing 25 but via a balance arm 23. Preferably in the current embodiment, the balance container 60 and its contained effluence 61 can be selected to be respectively the same as source container 1 and its contained source effluence 2. Likewise, the size and weight of the balance container holder 22 and the balance arm 23 can be selected to be respectively the same as the source container holder 20 and the source arm 21. However, although the members 20, 21, 22 and 23 are made as one rigid body, there is a definite built-in angular asymmetry in that the axis of the balance container 60 lies horizontally while the axis of the source container 1 subtends an angle of $\theta_1$ with the vertical. The reason for this asymmetry will be presently explained. An interference tab 24 located near one edge of the balance container holder 22 is designed to work cooperatively with a notch 41 of a cover plate 40 of the receiving reservoir. A flexible cable 26, with its one end tied to a bottom corner of the balance container holder 22, is disposed to pass over a pulley 27 and terminates at the other end with a handle 28. Thus, as the handle 28 gets manually pulled downwards, the balance container holder 22 will be rotationally lifted upwards around the pivot with bearing 25 through the combined action of the flexible cable 26 and the pulley 27, and vice versa in the reverse direction. However, as illustrated, the handle 28 is restricted from moving upwards by a catch surface 30 of a fixed catch 29 that is integrated with a frame of the system, not shown here for simplicity. An adjustable damper mechanism 53, comprising a damper plate 52 that is rotatably tied to a fixed strut 50 through a damper pivot point 51, is disposed above the initial starting position of the source container 1 as indicated. Furthermore, the position of the strut 50 can be adjusted vertically with respect to a frame of the system. The corresponding functions of the adjustable damper mechanism 53 will be described later.

Figure 2:
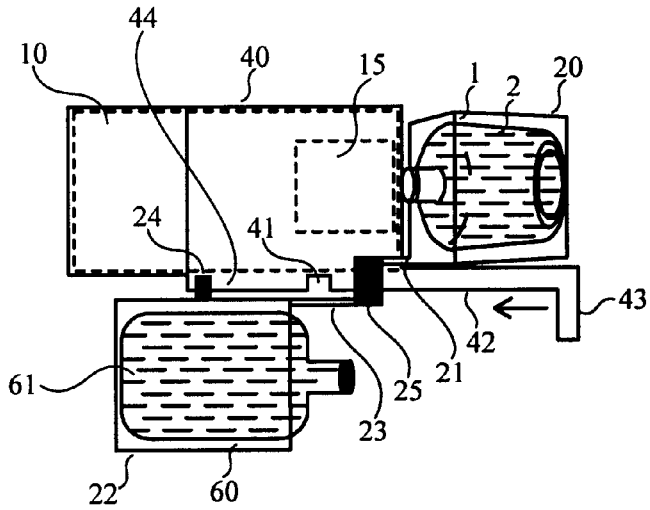
FIG.-2 and FIG.-3 illustrate, via a top view of part of the CBETS, the functionality of the above-mentioned integral safety interlock feature that is integrated with a receiving reservoir cover plate.
Figure 3:
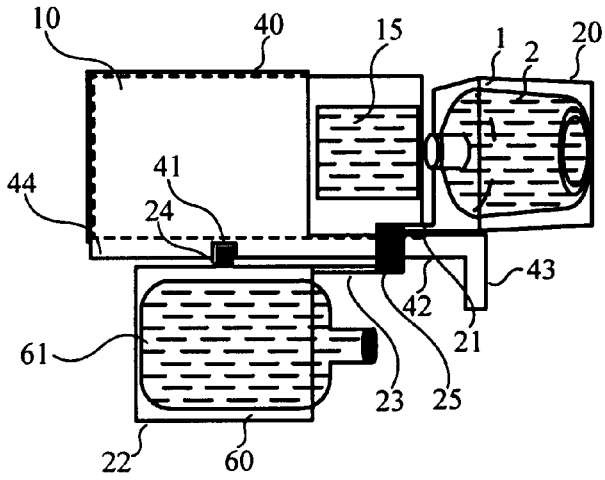

FIG.-2 and FIG.-3 illustrate, via a top view (A—A) of part of the CBETS as shown in FIG.-1, the functionality of the above-mentioned integral safety interlock feature that is integrated with the cover plate 40 of the receiving reservoir. With the cover plate 40 located toward the right as shown in FIG.-2, the cover plate 40 would either partially or completely cover up, from the top, a reservoir top opening 15 of the receiving reservoir 10. At the same time, the notch 41 of the cover plate 40 is located to the right of the interference tab 24 of the balance container holder 22 such that a lower edge 44 of the cover plate 40 would block any downward movement of the assembly comprising the balance container 60 and the balance container holder 22 from its initial starting position. This results in, through the structure of the balance arm 23, the pivot with bearing 25 and the source arm 21, the prevention of any upward swinging of the assembly comprising the source container 1 and the source container holder 20 from its initial starting position that would otherwise start the out pouring of the source effluence 2 from the source container 1. After the cover plate 40 is pushed, via the handle 43 and a linkage arm 42 in a direction as indicated by the left-pointing arrow in FIG.-2, all the way to the left by an operator to a position as indicated in FIG.-3, the cover plate 40 has completely cleared the reservoir top opening 15 of the receiving reservoir 10 for the receiving source effluence 2 from the source container 1. At the same time, the location of the notch 41 now matches that of the interference tab 24, which subsequently allows downward movement of the assembly comprising the balance container 60 and the balance container holder 22 from its initial starting position. This permits, through the structure of the balance arm 23, the pivot with bearing 25 and the source arm 21, the upward swinging of the assembly comprising the source container 1 and the source container holder 20 from its initial starting position such that the out pouring of the source effluence 2 from the source container 1 into the now fully open reservoir top opening 15. In other words, this integral safety interlock feature works to prevent any out pouring of the source effluence 2 from the source container 1 until the reservoir top opening 15 of the receiving reservoir 10 is fully exposed for the receiving source effluence 2.

Figure 4:
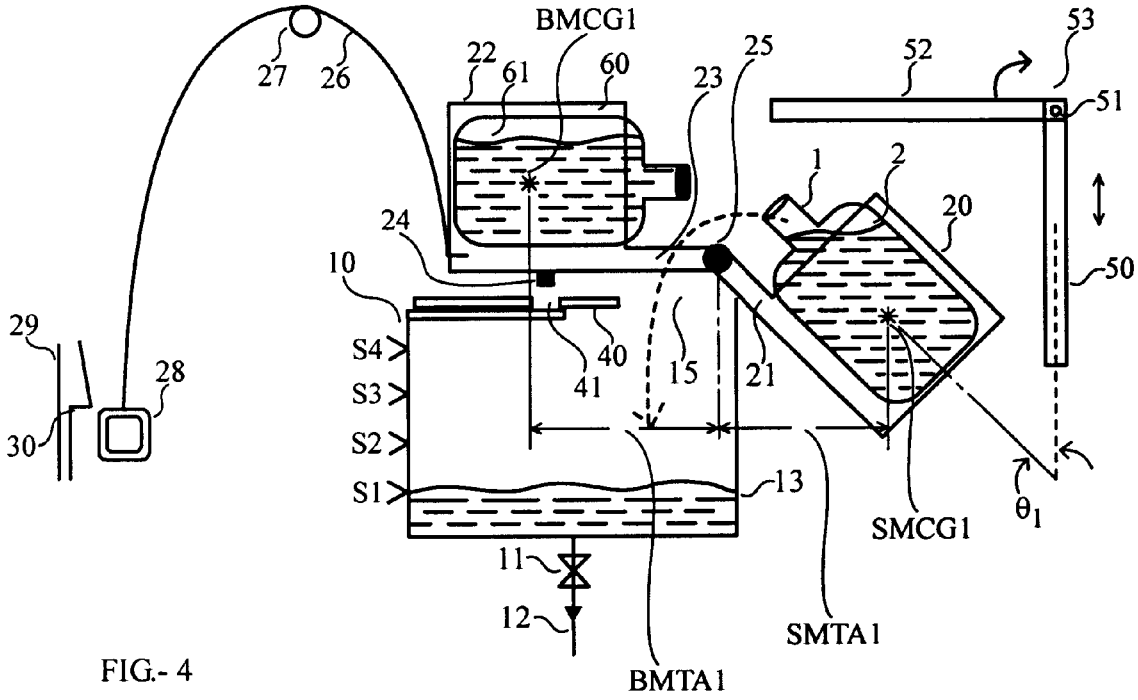
FIG.-4 illustrates a second side view of the current CBETS in its starting state wherein the above-mentioned handle component has been moved into its unlatched position to enable the starting of the effluence transferring process.

With the above-described integral safety interlock feature being pushed into the position as indicated in FIG.-3, a second side view of the CBETS in its starting state wherein the handle 28 is just moved into its unlatched position to enable the starting of the effluence transferring process is illustrated in FIG.-4. The combined weight of the source container 1, the source effluence 2, the source container holder 20 and the source arm 21 acts to produce a source torque $T_s$ urging a clockwise rotation of these members with respect to the pivot with bearing 25. For simplicity of explanation, the source torque $T_s$ can be mathematically expressed as follows:

$$\text{source torque } T_s = W_s \times SMTA1, \tag{1}$$

where $W_s$ is an equivalent source weight that is simply the combined weight of the source container 1, the source effluence 2, the source container holder 20 and the source arm 21; and SMTA1 is a source mechanism torque arm 1 that is the equivalent distance between the pivot with bearing 25 and $W_s$ as if $W_s$ were all located at a single point called source mechanism center of gravity 1, or SMCG1.

However, on the other hand, the combined weight of the balance container 60, the balance effluence 61, the balance container holder 22 and the balance arm 23 acts to produce a balance torque $T_b$ urging a counterclockwise rotation of these members with respect the pivot with bearing 25. Without losing the essential spirit and scope of the present invention, the additional effect on torque from elements like the handle 28 and the flexible cable 26 are neglected as they are much lighter in weight compared to, for example, the weight of the balance effluence 61. Thus, the balance torque $T_b$ can similarly be mathematically expressed as follows:

$$\text{balance torque } T_b = W_b \times BMTA1, \tag{2}$$

where $W_b$ is an equivalent balance weight that is simply the combined weight of the balance container 60, the balance effluence 61, the balance container holder 22 and the balance arm 23; and BMTA1 is a balance mechanism torque arm 1 that is the equivalent distance the pivot with bearing 25 and $W_b$ as if $W_b$ were all located at a single point called balance mechanism center of gravity 1, or BMCG1.

A final factor affecting the mechanics of the effluence transferring process is the frictional torque, designated $T_f$, coming from areas like the pivot with bearing 25 and the interface between the flexible cable 26 and the pulley 27. Frictional torque $T_f$ acts to resist any clockwise or counterclockwise rotation of the system until the availability of a net system torque that exceeds $T_f$. That is, to start the counterclockwise rotation of the system to effectuate the effluence transferring process, the following mathematical relationship (3A) must be satisfied:

$$\text{balance torque } T_b - \text{source torque } T_s > \text{frictional torque } T_f \tag{3A}$$

In one embodiment of the current invention, for simplicity of system set up, the balance container 60 with its enclosed balance effluence 61 is selected to be the same as the source container 1 with its enclosed source effluence 2. Likewise, the balance container holder 22 and the balance arm 23 are also respectively made to be the same size and weight as the source container holder 20 and the source arm 21. Therefore, $$W_b = W_s \tag{4}$$

However, an angular asymmetry between the balance arm 23 and the source arm 21 is built in the system in that, while the balance arm 23 lies along a horizontal direction, the direction of the source arm 21 is selected to make a subtended angle $\theta_1$ with the vertical resulting in the following relationship:

$$BMTA1 > SMTA1 \quad (5)$$

It follows from the equations (1), (2), (4) and (5) that the balance torque $T_b$ is larger than the source torque $T_s$ in such a manner that the magnitude of their difference may be significantly adjustable with the subtended angle $\theta_1$. In fact, in the present embodiment, the subtended angle $\theta_1$ is selected to be of such a value that the equation (3A) is satisfied. Hence, upon release of the handle 28 from the catch surface 30 of the fixed catch 29, as shown in FIG.-4, the system comprising the source container 1, the source effluence 2, the source container holder 20, the source arm 21, the balance container 60, the balance effluence 61, the balance container holder 22 and the balance arm 23 would immediately start a counterclockwise rotation around the pivot with bearing 25, resulting in the transfer of the desired effluence from the source container 1 into the receiving reservoir 10 via the reservoir top opening 15.

It is important to note that, in view of the equations (1) and (2), there are many alternative means whereby the equation (3A) can be implemented to achieve the desired effluence transferring process. For one example, the balance container 60 with the balance effluence 61 can be selected to be larger in size than the source container 1 with the source effluence 2. For another example, the balance effluence 61 can be made of a material having a higher specific gravity than that of the source effluence 2. A third example would be the use of a balance arm 23 that is longer than the source arm 21. A fourth example would be the replacement of the balance container 60 with a calibrated balance weight that will be presently described in FIG.-9. A fifth example would be the combination of a portion or all of the above-stated examples of implementation. Nevertheless, the embodiment as exemplified in FIG.-4 has a unique advantage of being simple and reliable for the handling of a variety sizes of source container and source effluences in that, for each selected combination of the source container size and the type of effluence, the operator only requires to place another identical container within the balance container holder 22 for the set-up.

Figure 5:
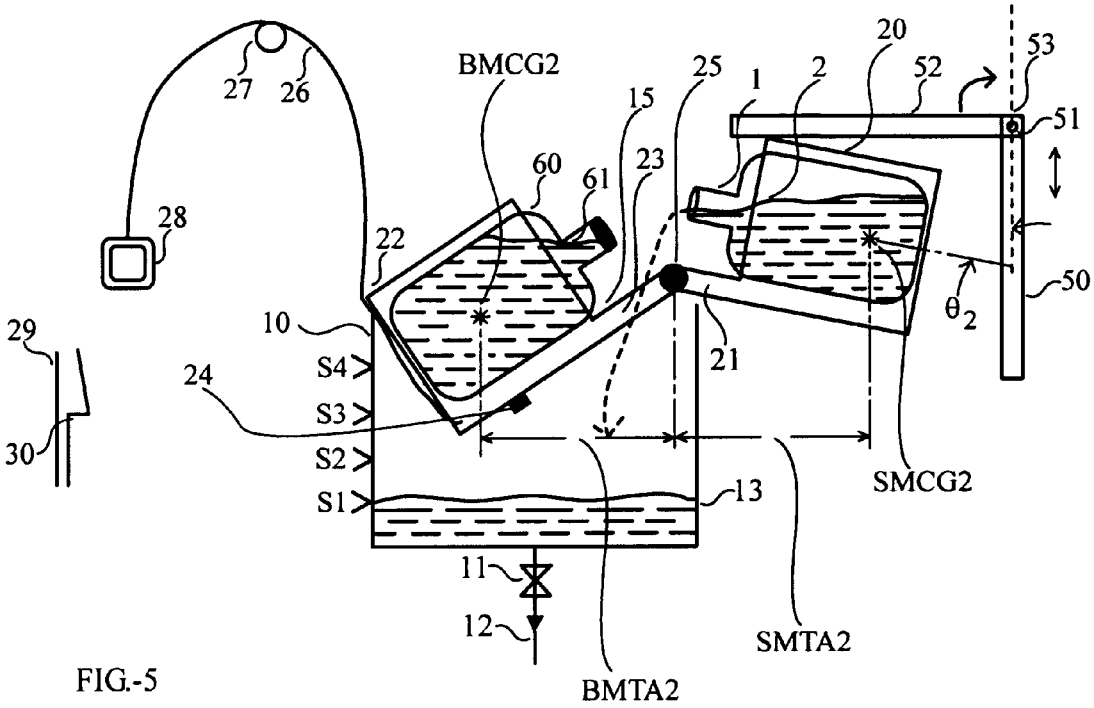
FIG.-5 illustrates a third side view of the current CBETS during the middle of the effluence transferring process wherein the effluence of a source container has been partially transferred into a receiving reservoir.

Continuing the effluence transferring process, FIG.-5 illustrates a third side view of the present CBETS where the source effluence 2 of the source container 1 has been partially transferred into the receiving reservoir 10. Notice that, as the mechanical system has rotated into a second orientation $\theta_2$, the two torque arms BMTA2 and SMTA2 become more or less equal. However, due to loss of the source effluence 2, the new equivalent source weight $W_{s2}$ has significantly reduced from its starting value $W_s$. Or equivalently, $$W_{s2} << W_b \quad (6)$$

Thus, the relationship (3A) is again satisfied insuring the continuing counterclockwise rotation of the mechanical system till the completion of the effluence transfer process. In fact, in light of the relationship (6), the relationship (3A) should now be rewritten as:

$$\text{balance torque } T_b - \text{source torque } T_s >> \text{frictional torque } T_f \quad (3B)$$

Figure 6:
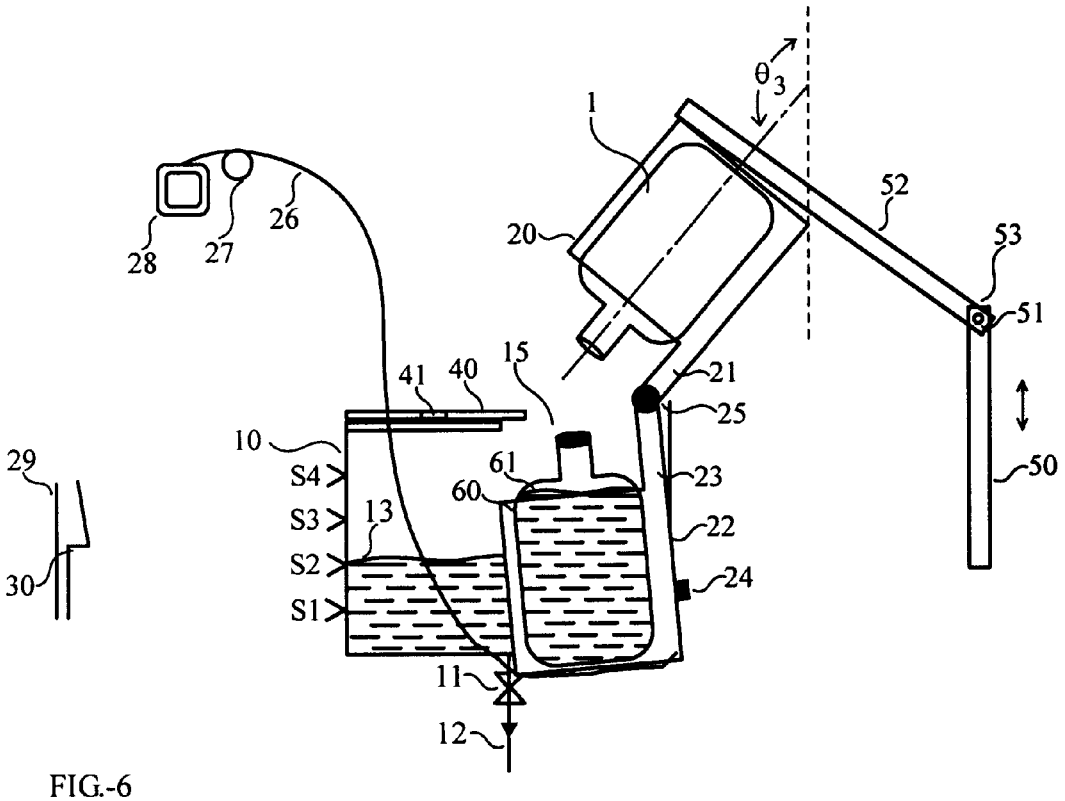
FIG.-6 illustrates a fourth side view of the current CBETS toward the end of the effluence transferring process wherein the effluence of a source container has been completely transferred into a receiving reservoir.

This means that, due to the emptying of the source effluence 2 from the source container 1, the continuing counterclockwise rotation of the mechanical system could accelerate to an excessive degree causing undesirable shock, noise and vibration toward the end of the effluence transfer process. To counteract this effect, the aforementioned adjustable damper mechanism 53 is employed. Notice that, toward the beginning of the effluence transfer process as shown in FIG.-4, the source container 1 and the source container holder 20 have not touched the damper plate 52 and the adjustable damper mechanism 53 performed no function. However, as illustrated in FIG.-5, the adjustable damper mechanism 53 begins to perform a function when the source container holder 20 swings into contact with the damper plate 52. While it is rotatable with respect to the fixed strut 50, the weight of the damper plate 52 does provide a counteracting damping torque to the mechanical system as it continues to rotate to its final position of $\theta_3$ in FIG.-6 where the source effluence 2 has been completely emptied into the receiving reservoir 10 with a final reservoir effluence level 13 at an elevation of S2. Notice that, through the combined action of the flexible cable 26 and the pulley 27, the handle 28 is now moved to a high point by the mechanical system.

Figure 7:
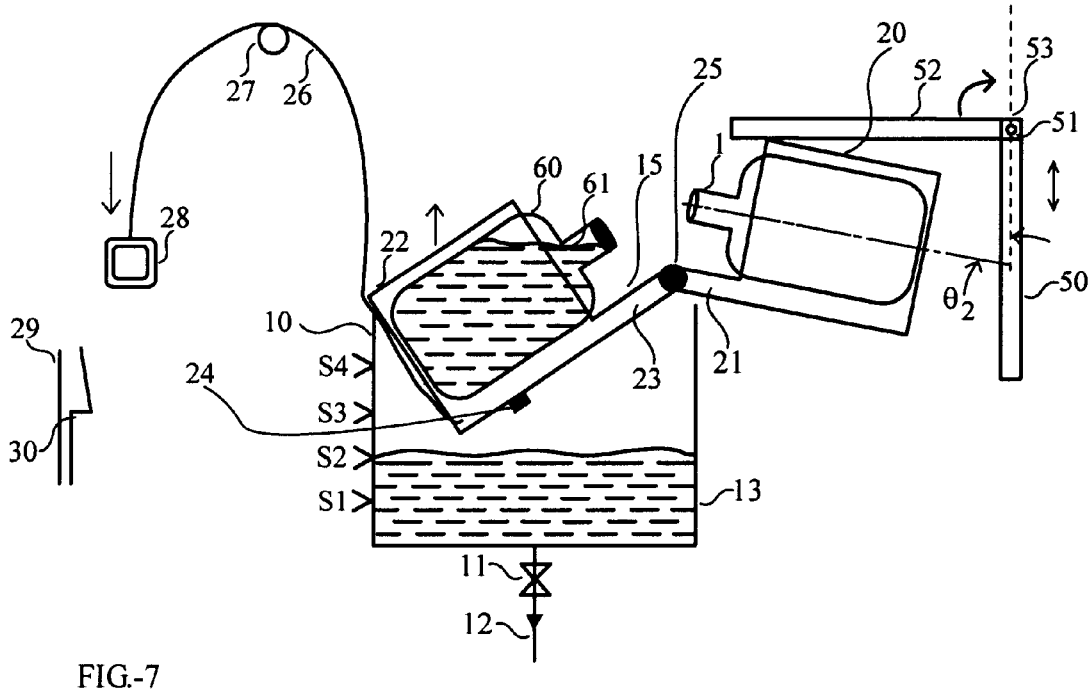
FIG.-7 illustrates a fifth side view of the current CBETS wherein the above-mentioned handle component is partially pulled down toward its initial latched position.
Figure 8:
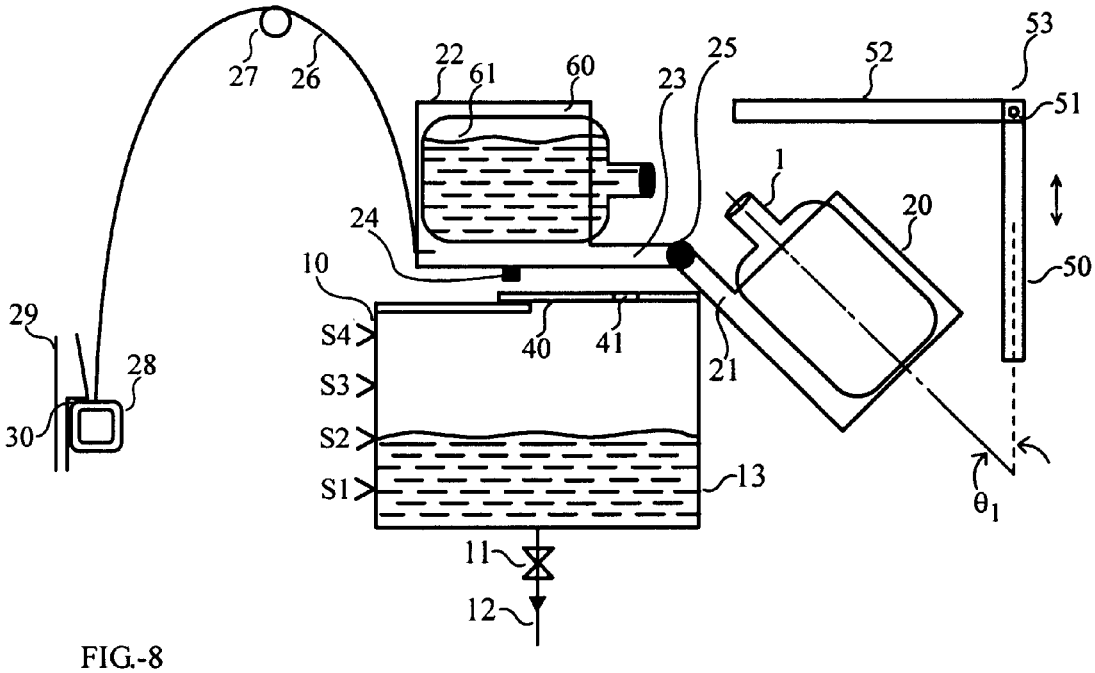
FIG.-8 illustrates a sixth side view of the current CBETS that returned to its initial starting state with the above-mentioned handle component returned to its latched position.

To return the CBETS to its initial state, an operator of the system would manually pull the handle 28 all the way down and latch it against the catch surface 30 the fixed catch 29, these steps are respectively illustrated in FIG.-7 and FIG.-8. Of course, at this time, the emptied source container 1 can be replaced with another one and the whole effluence transfer process repeated again.

Figure 9:
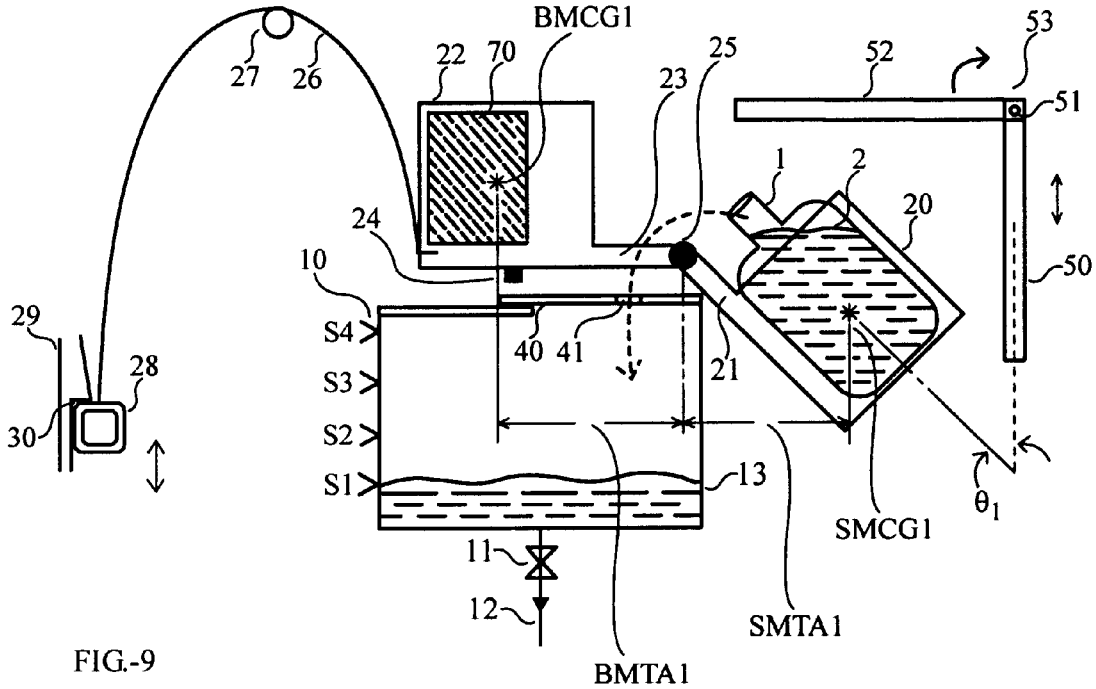
FIG.-9 illustrates a side view of another embodiment of the current CBETS wherein a component of balance container is replaced with a balance weight.

FIG.-9 illustrates a side view of an aforementioned embodiment of the CBETS wherein the balance container 60 with the balance effluence 61 is replaced with a balance weight 70. To maintain similar functionality as the system depicted in FIG.-1, the weight of the balance weight 70 can simply be made the same as the combined weight of the balance container 60 and the balance effluence 61.

Figure 10:
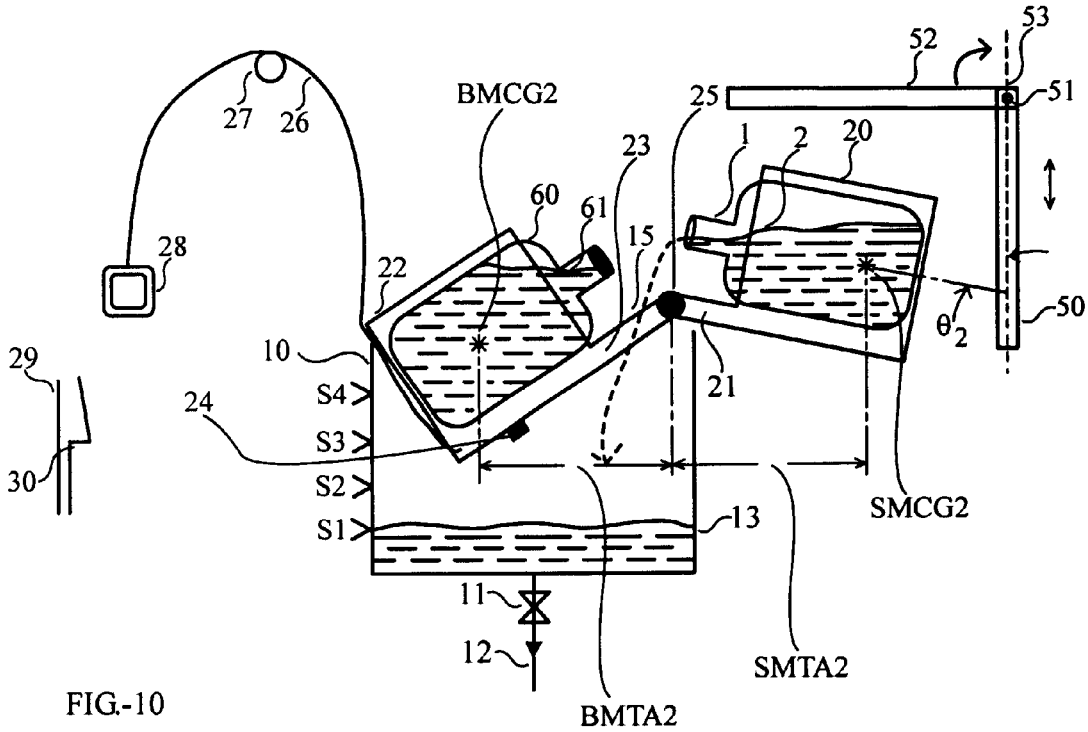
FIG.-10 illustrates a side view of yet another embodiment of the current CBETS wherein a component of adjustable damper mechanism is moved to a higher position compared to that illustrated in FIG.-5.

FIG.-10 illustrates a side view of yet another embodiment of the CBETS wherein the adjustable damper mechanism 53 is moved to a higher position compared to that illustrated in FIG.-5.While both of the mechanical systems as illustrated in FIG.-5 and FIG.-10 have rotated into the same second angular position $\theta_2$, the source container holder 20 in FIG.-5 just swings into contact with the damper plate 52 while the source container holder 20 in FIG.-10 has yet to touch the damper plate 52. This means that the damping action of the CBETS in FIG.-10 will set in at a later stage of the effluence transfer process than the CBETS in FIG.-5. In other words, the CBETS in FIG.-10 will produce a lesser degree of damping than the CBETS in FIG.-5.

As described, a specific set of embodiments of a counter balanced effluence transfer system, or CBETS, and associated methods of operation have been described for the semi-automatic transferring of effluence from a source container into a receiving reservoir. The invention has been described using exemplary preferred embodiments. However, for those skilled in this field, the preferred embodiments can be easily adapted and modified to suit additional applications without departing from the spirit and scope of this invention. Thus, it is to be understood that the scope of the invention is not limited to the disclosed embodiments. On the contrary, it is intended to cover various modifications and similar arrangements based upon the same operating principle. The scope of the claims, therefore, should be accorded the broadest interpretations so as to encompass all such modifications and similar arrangements.

We claim:

1. A counter balanced effluence transfer system for safe and semi-automatic transferring of effluence from a source container into a receiving reservoir comprising:

a receiving reservoir comprising a cover plate and a reservoir top opening for receiving an effluence;

a counter balanced mechanism, or CBM, fixedly located above the receiving reservoir to provide for an inherent frictional torque, designated as $T_f$, resisting any rotation of the CBM wherein the CBM further comprising;

a pivot point with bearing;

a source-side member having a source arm and a source container holder rotatably attached to a first side of said pivot point with bearing to hold a replaceable source container having a desirable amount of source effluence enclosed wherein a gravitational source torque $T_s$ around the pivot point with bearing is produced by the source-side member; and a balance-side member having a balance arm and a balance container holder rotatably attached to a second side of said pivot point with bearing to hold a balance container having a desirable amount of balance effluence enclosed wherein a gravitational balance torque $T_b$ around the pivot point with bearing is produced by the balance-side member;

whereby the two torques $T_s$ and $T_b$ oppose each other and are unequal to create a resulting difference torque, $\Delta T$, defined as $|T_s - T_b|$, which is larger than $T_f$ such that, in the absence of any additional externally applied force or torque, the resulting initial direction of rotation of the CBM will start and dynamically maintain an effluence transfer process whereby the source effluence enclosed in said source container will be completely poured into said receiving reservoir.

2. The counter balanced effluence transfer system as stated in claim 1 further comprises an adjustable damping assembly which consists of a movable damping element being disposed near an initial position of the CBM at the beginning of the effluence transfer process such that the CBM will contact the movable damping element whereby subsequent motion of the CBM will be damped for the suppression of undesirable shock, noise and vibration toward the end of the effluence transfer process.

3. The counter balanced effluence transfer system as stated in claim 2 wherein the movable damping element is a damper plate being located rotatably near the source container.

4. The counter balanced effluence transfer system as stated in claim 1 further comprises a motion-prevention means which is attached to the CBM to prevent undesirable movement of the CBM before the start of the effluence transfer process.

5. The counter balanced effluence transfer system as stated in claim 4 wherein the motion-prevention means further comprises a handle and a fixed catch such that the effluence transfer process can only be started with a movement of the CBM following the release of the handle from the fixed catch.

6. The counter balanced effluence transfer system as stated in claim 4 wherein the motion prevention means further comprises a pulley with a coupled flexible cable to coordinate the movement of the CBM and the handle.

7. The counter balanced effluence transfer system as stated in claim 1 further comprises a safety interlock means such that, unless the receiving reservoir cover plate is pushed to completely expose the reservoir top opening, the safety interlock means will block the CBM from any movement thus preventing the start up of the effluence transfer process.

8. The counter balanced effluence transfer system as stated in claim 7 wherein the safety interlock means further comprises a notch which is integrated with the receiving reservoir cover plate and an interference tab being integrated with the CBM.

9. The counter balanced effluence transfer system as stated in claim 8 wherein the safety interlock means further comprises an interference tab which is integrated with the CBM.

10. The counter balanced effluence transfer system as stated in claim 1 wherein the source-side member further comprises a source container and a source effluence.

11. The counter balanced effluence transfer system as stated in claim 10 wherein the balance-side member further comprises a balance container and a balance effluence.

12. The counter balanced effluence transfer system as stated in claim 11 wherein the total weight of balance-side member is made unequal to the total weight of the source-side.

13. The counter balanced effluence transfer system as stated in claim 1 wherein a subtended angle between the axis of the source arm and vertical direction is made unequal to a subtended angle between the axis of the balance arm and vertical direction.

* * * * *